United States Patent [19]

Maher

[11] 4,387,604

[45] Jun. 14, 1983

[54] TOY INERTIA MOTOR

[75] Inventor: William M. Maher, Churchville, N.Y.

[73] Assignee: The Quaker Oats Company, Chicago, Ill.

[21] Appl. No.: 228,779

[22] Filed: Jan. 27, 1981

[51] Int. Cl.[3] ..... F16H 3/34; A63H 17/00; A63H 29/20

[52] U.S. Cl. ..... 74/354; 46/209; 46/206

[58] Field of Search ..... 46/202, 206, 209; 74/354, 397, 572

[56] References Cited

U.S. PATENT DOCUMENTS

| | | | |
|---|---|---|---|
| 3,546,809 | 12/1970 | Nielsen | 46/206 |
| 3,798,831 | 3/1974 | Higashi | 46/206 |
| 3,919,804 | 11/1975 | Nakata | 46/206 |
| 4,059,918 | 11/1977 | Matsushiro | 46/209 |
| 4,116,084 | 9/1978 | Masuda | 46/209 |
| 4,130,963 | 11/1978 | Ohashi | 46/209 |
| 4,141,256 | 2/1979 | Wilson | 46/209 |
| 4,201,011 | 5/1980 | Cook | 46/209 |
| 4,283,879 | 8/1981 | Tsui | 46/209 |

*Primary Examiner*—Kenneth Dorner
*Assistant Examiner*—D. Wright
*Attorney, Agent, or Firm*—Cumpston & Shaw

[57] ABSTRACT

A toy inertia motor for driving a rotatable power or drive shaft. The drive shaft is coupled, for example, to any suitable members or mechanisms such as the drive wheels on a toy car, or a windlass.

The motor comprises a rotatable flywheel, and separate winding and driving gear trains for coupling the flywheel to the drive shaft. A gear of the winding and driving gear trains is movable, in response to rotation of the drive shaft, between a normal drive position in the driving gear train to a wind position in the winding gear train. A latch is responsive to such gear movement for releasably latching the gear in its wind position. When so latched, the flywheel inertia can be built up by rotating the flywheel. When the latch is released, the gear returns to its drive position and the flywheel inertia is transmitted via the driving gears to the drive shaft.

9 Claims, 6 Drawing Figures

TOY INERTIA MOTOR

BACKGROUND OF THE INVENTION

1. Field of the Invention

The present invention relates generally to toy drive motors, and more particularly, to an improved toy inertia motor.

2. Description of the Prior Art

U.S. Pat. No. 3,798,831 discloses an inertia motor for a toy vehicle in which pressing downwardly on the vehicle body couples a first gear to a winding gear train for winding a spring upon rotation of the drive wheels. When the downward pressure is released, the first gear is decoupled from the spring, and a second gear in the driving gear train is coupled to the drive wheels for transmitting the spring force through the driving gear train to the drive wheels.

U.S. Pat. No. 3,919,804 relates to an inertia motor powered toy vehicle in which pressing downwardly on the handle of a vertical bar couples a gear to a spring for winding the spring. Upward movement of the handle and bar decouples the gear from the spring. When the vehicle is released, the spring force is transmitted to the drive wheels through a driving gear train which directly couples the spring to the drive wheels.

U.S. Pat. No. 3,546,809 discloses a multiple speed toy vehicle having a gear linkage including two alternate gear trains coupling a motor to a drive wheel for propelling the vehicle at either of two different speeds. Latch means are provided for releasably latching a common idler gear assembly in one of two positions for propelling the vehicle at one of the two speeds. When the latch is released, the gear assembly is returned to its normal position whereby the vehicle is propelled at the other of the two speeds.

SUMMARY OF THE INVENTION

It is a primary object of the present invention to provide an improved toy inertia motor for driving a rotatable drive shaft.

Briefly, the inertia motor comprises a rotatable flywheel, a rotatable drive shaft, and separate winding and driving gear trains selectively coupling the flywheel to the drive shaft. The selective coupling is achieved by a first gear normally in a drive position in the driving gear train when the motor is driving or at rest, and movable by rotation of the drive shaft to a wind position in the winding gear train when torque is applied to the flywheel bringing it up to speed. A latch is responsive to the movement of the first gear into the winding gear train to latch the first gear in its wind position. In this wind position, rotation of the drive shaft in the proper direction by an applied torque couples the drive shaft to the flywheel to impart rotation to the flywheel upon further rotation of the drive shaft. Release of the latch after the applied torque is terminated causes the first gear to return to its drive position, and the flywheel to transmit its energy through the driving gear train to the drive shaft.

In another aspect of the invention, the flywheel has a shaft onto which a second gear is mounted. The winding gear train has a movable third gear interposed between the first and second gears in the winding gear train. The third gear has a normal position in which it is disengaged from the second gear. The third gear is movable by the first gear into a second gear engaged position upon rotation of the drive shaft by an applied torque.

In a more specific aspect of the invention, spring means are provided for biasing the first and third gears into their driving and second gear disengaged positions respectively.

One of the primary advantages of the toy inertia motor of this invention, for example, is to eliminate the need in some prior inertia motors of retaining the drive wheels of a vehicle in constant pressure engagement with a floor or the like during back and forth movement of the vehicle, or reciprocal movement of a plunger, to wind up a spring or inertia wheel.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
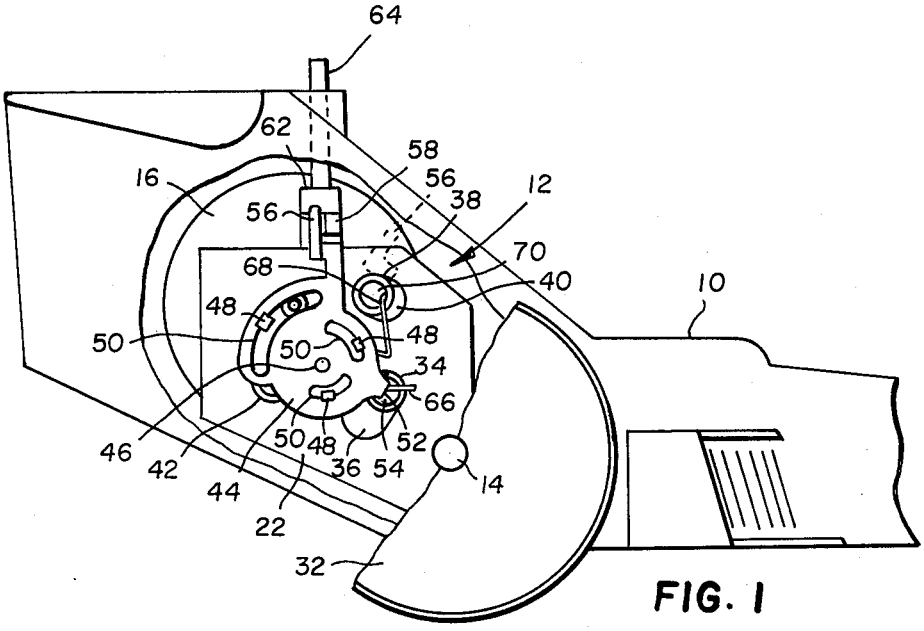
FIG. 1 is a side elevational view of a toy racing vehicle with a portion thereof broken away to show the inertia motor mounted therein for driving the drive wheels, the inertia motor being shown in the position in which torque is being applied from the drive wheels to the flywheel.
Figure 2:
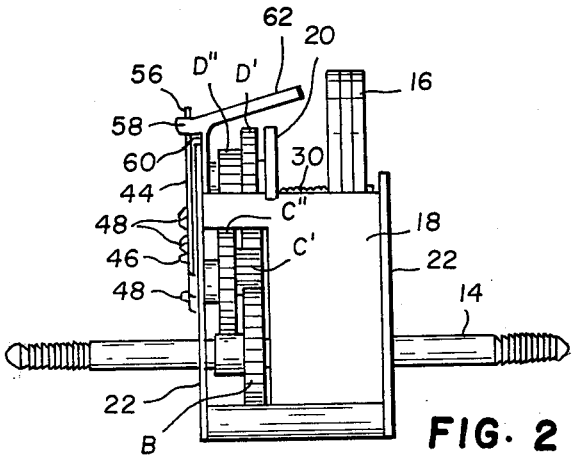
FIG. 2 is a side or end view of the inertia motor of FIG. 1.
Figure 3:
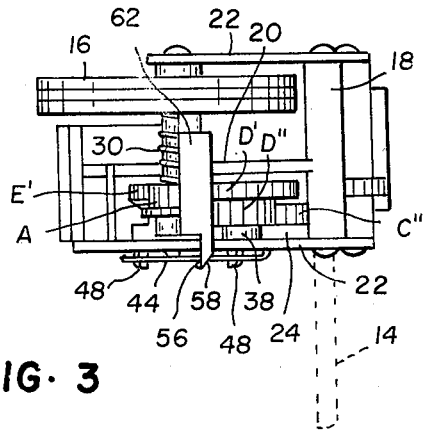
FIG. 3 is a top plan view of the inertia motor of FIG. 1.

Referring to FIGS. 1–3 of the drawings, a toy racer or dragster 10 is shown in which a preferred embodiment of the inertia motor 12 of this invention is incorporated. The inertia motor is shown in a winding position prepared for torque to be applied by a drive shaft 14 to a flywheel 16.

The inertia motor 12 comprises a plastic block 18 having a wall 20 forming a pair of side-by-side cavities. Parallel metal side plates 22 are secured to opposite sides of block 18 to form adjacent gear and flywheel housings 24, 26. Plastic gears A, B, C, D and E, to be discussed in greater detail hereinafter, are located within gear housing 24, and inertia flywheel 16 is located within housing 26.

Inertia flywheel 16 is formed from a plurality of metal circular disks secured together and to a shaft 28, the ends of which are rotatably journaled in side plates 22. A flywheel gear A is loosely mounted on shaft 28, and is coupled to flywheel 16 by a spring clutch 30 encircling shaft 28 and interposed between flywheel 16 and gear A. The clutch 30 allows gear A to slip in the event, for example, the flywheel and shaft are rotating at a high speed, and gear A is prevented from rotating by any means.

Power or drive shaft 14 extends through and is rotatably mounted in side plates 22. Drive wheels 32 are secured to end portions of shaft 14, and a gear B is secured to shaft 14 for rotation within gear housing 24.

Figure 4:
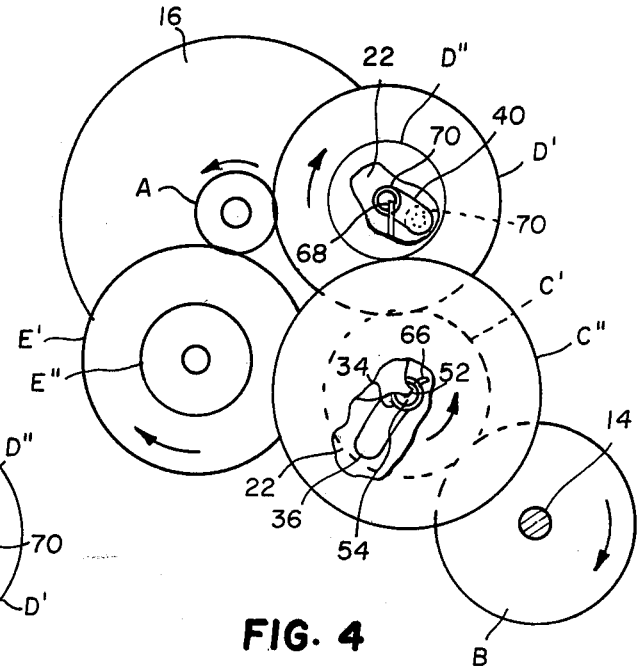
FIG. 4 is an enlarged side elevational view of FIG. 1 with most of the front plate removed to show the first gear latched in its wind position, and the third gear moved by the first gear into meshing engagement with the second gear for rotating the flywheel.

With reference to FIG. 4, a winding gear train for coupling gear B to gear A for imparting a winding torque to flywheel 16 will be described. By manually pushing drive wheels 32 along a floor surface in a forward, clockwise direction as indicated by arrows, the rotation of gear B, due to the torque applied thereto, is coupled to flywheel 16 for rotating the flywheel at a high speed in the direction indicated.

The winding gear train, in addition to gears A and B, comprises movable double gears C and D having gears C′, D″ of small diameter respectively and gears C″, D′ of large diameters. Gear C′ is in meshing engagement with gear D′. Gear D′ is in meshing engagement with gear A. Gear C is rotatable and movable along an arcuate path by virtue of a pair of stub shafts 34 journaled in arcuate slots 36, only one of which is shown, in wall 20 and one of side plates 22. Slots 36 are arcs of a circle having a center at the axis of drive shaft 14. Gear D is also rotatable and movable along a straight path by virtue of a pair of stub shafts 38 journaled in substantially straight slots 40, only one of which is shown, in wall 20 and one of the side plates 22.

Figure 5:
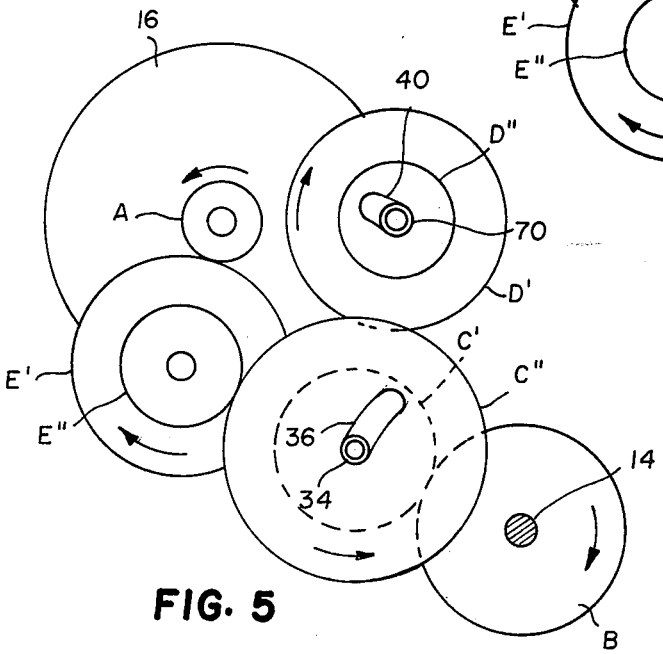
FIG. 5 is an enlarged side elevational view similar to FIG. 4 of the inertia motor of FIG. 1 showing the gears in the driving or rest position after the first gear is unlatched.

With reference to FIG. 5, a driving gear train for coupling gear A to gear B for imparting energy from flywheel 16, rotating at high speed, to drive wheels 32 will be described. The driving gear train, in addition to gears A, B and C comprises double gear E. Gear E is an idler gear having stub shafts 42 journaled for rotation in wall 20 and one of the side plates 22. Gear E has one gear E′ of large diameter in meshing engagement with gears A and C′, and another gear E″ of small diameter in meshing engagement with gear C″. Gear C′ is in meshing engagement with gear B.

Gear C, by virtue of the aforementioned arcuate slots 36, is movable between a normal drive position in the driving gear train, as best seen in FIG. 5, and a wind position in the winding gear train, as best seen in FIG. 4. Gear C is automatically moved to its wind position by the application of sufficient torque to drive shaft 14, such torque rotating the drive shaft and gear B in a forward or clock-wise direction. Rotation of gear B at low revolutions per minute due to insufficient torque causes gears C′, C″ to partially walk around gears E′, E″ respectively (held by the inertia of the flywheel at rest) until gear C′ continuously slips on gear B. When sufficient torque is applied to drive shaft 14, the rotation of the drive shaft and gear B causes gears C′, C″ to move or ride further around gears E′, E″ and into its wind position, in which gears C′, C″ are in meshing engagement with gears D′, D″ respectively, and disengaged from gears E′, E″.

Figure 6:
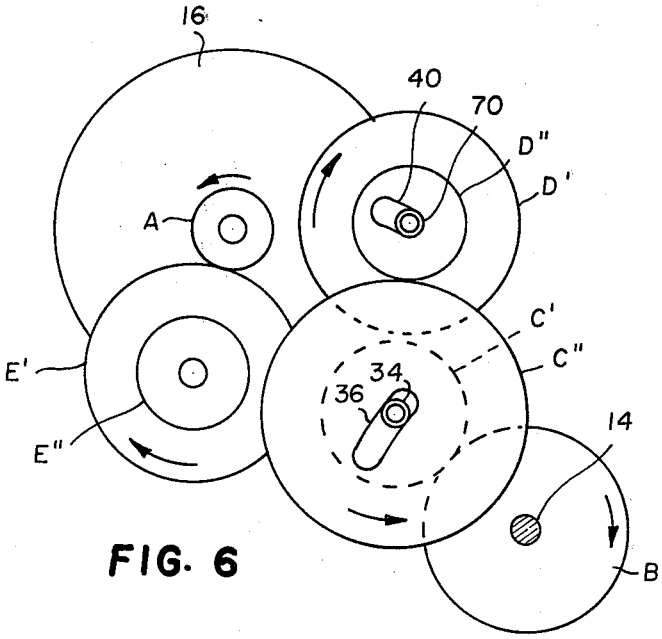
FIG. 6 is a side elevational view similar to FIG. 4 showing the gears in the winding position with the first gear latched, the third gear in its normal second gear disengaged position, and the flywheel in position to freewheel.

Latch means are provided, as best seen in FIGS. 1, 2 and 3, for releasably holding gear C in its wind position. The latch means comprises a flat plate member 44 pivotal about a post 46, and guided for pivotal movement by flexible fingers 48 extending from block 18 through arcuate slots 50 in plate member 44. The ends of fingers 48 overlap the edges of slots 50 which are centered about post 46. Plate member 44 has a depending finger 52 loosely extending into a blind bore 54 in one of stub shafts 34 of gear C to provide lost motion between the bore and finger for a purpose to be explained. Movement of gear C into its wind position imparts pivotal movement to plate member 44. During such movement, a radially extending and slightly canted cam lever 56 on a plate member 44 engages a tapered cam follower lug 58 of a flexible spring catch member 60, and cams it out of the way. When cam lever 56 moves past cam follower lug 58, catch member 60 returns to its normal position latching plate member 44 and gear C in its wind position, as best seen in FIG. 6. Catch member 60 has a laterally extending arm 62 engageable by a manually depressable release lever 64 on the dragster for depressing are 62 and releasing latch plate 44. A substantially U-shaped wire spring 66 extends around post 46 and has one end bearing against finger 52 for biasing plate member 44 into its released position, as shown dotted in FIG. 1, and gear C into its normal drive or rest position in the driving gear train, as best seen in FIG. 5.

When gear C is latched in its wind position and torque is applied to drive wheels 32 by, for example, moving the drive wheels across a floor surface in a forward or clockwise direction, as seen in FIGS. 1 and 4, gear C is moved upwardly to the end of its slots 36 causing gears C′, C″ to engage gears D′, D″ respectively and move gear D′ into meshing engagement with gear A. When the torque applied to drive wheels 32 is reduced or terminated, gear D is returned to its normal gear A disengaged position, as best seen in FIG. 6. This is achieved by a spring end 68, which extends into a blind bore 70 in stub shaft 38 of gear D, and by the kicking action of flywheel gear A against gear D. The movement of gear D to its gear A disengaged position causes a slight downward movement of gear C within its slots 36. Such downward movement of gear C is possible due to the aforementioned lost motion between finger 52 and blind bore 54. In the gear A disengaged position, flywheel 16 is in a freewheeling position. The engagement and disengagement of flywheel gear A in response to the torque applied allows winding the flywheel to a high speed by intermittent application of torque to the drive wheels.

Releasing latch lug 58 by depressing release lever 64, after the repetitively applied torque to the drive wheels is terminated, allows spring biased plate member 44 to move gear C to its drive position, and allows gear D to move to its gear A disengaged position, as seen in FIG. 5. In this drive position, rotatable flywheel 16 is directly coupled through the driving gear train (gears A, E, C and B) to drive wheels 32.

The gear sizes and ratios are preferably selected to achieve a winding revolutions per minute ratio from drive shaft 14 to flywheel 16 of 1 to 15.2, and a driving revolutions per minute ratio from the flywheel to the drive wheels of 15.2 to 1. These ratios are exemplary only, and any other equal or unequal ratios can be selected.

While a presently preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A toy inertia motor for driving a rotatable drive shaft comprising:

a rotatable flywheel for storing energy when rotated;

a rotatable drive shaft;

a winding gear train for coupling said drive shaft to said flywheel for rotating said flywheel at high speed upon rotation of said drive shaft in one direction by an applied force;

a driving gear train coupling said flywheel to said drive shaft for transmitting the energy of said rotating flywheel to said drive shaft for driving said drive shaft in said one direction;

a first gear of said winding and driving gear trains movable, in response to rotation of said drive shaft in said one direction, from a normal drive position, in which said first gear is a part of said driving gear train and disengaged from said winding gear train, to a wind position, in which said first gear is a part of said winding gear train and disengaged from said driving gear train;

latch means responsive to movement of said first gear to its wind position for latching said first gear in said wind position whereby rotation of said flywheel to a high speed through said winding gear train is possible; and means for releasing said latch means after said flywheel is rotating at high speed whereby said first gear is disengaged from said winding gear train and returned to its normal drive position in said driving gear train for transmitting the energy from said rotating flywheel to said drive shaft.

2. A toy inertia motor according to claim 1, and further comprising spring means for biasing said first gear into its normal drive position.

3. A toy inertia motor according to claim 2 wherein said first gear has stub shafts, and means for guiding said stud shafts along an arcuate path during movement of said gear between said drive and wind positions.

4. A toy inertia motor according to claim 1 wherein said latch means comprises a pivotal member, a finger on said member coupled to said first gear, a cam lever on said member, and a flexible, tapered catch lug engageable by and cammed laterally from its initial position to a retracted position by said cam lever when said first gear is moved to its wind position, said lug returning to its initial position for latching said cam lever and said first gear in its wind position, and said means for releasing said latch means comprises a manually movable release lever coupled to said catch lug for moving it to its retracted position.

5. A toy inertia motor according to claim 4 wherein said first gear has a stub shaft having a blind bore, and said latch finger depends from said member into said bore, and said motor further comprises spring means for biasing said first gear into its normal drive position.

6. A toy inertia motor according to claim 1, and further comprising a flywheel shaft, a second gear on said flywheel shaft, and a third gear in said winding gear train interposed between said first gear and said flywheel gear and movable between a normal second gear disengaged position and a second gear engaged position, said third gear being movable into said second gear engaged position by said first gear when said drive shaft is rotated by an applied force in said one direction for imparting rotation to said flywheel through said winding gear train, said third gear returning to its normal second gear disengaged position when the applied force is terminated whereby said flywheel is substantially freewheeling.

7. A toy inertia motor according to claim 6, and further comprising spring means for biasing said first gear into its normal drive position and said third gear into its normal second gear disengaged position.

8. A toy inertia motor according to claim 6 wherein said latch means comprises a pivotal member, a finger on said member coupled to said first gear, a cam lever on said member, and a flexible tapered catch lug engageable by and cammed laterally from its initial position to a retracted position by said cam lever when said first gear is moved to its wind position, said lug returning to its initial position for latching said cam lever and said first gear in its wind position, and said means for releasing said latch means comprises a manually movable release lever coupled to said catch lug for moving it to its retracted position.

9. A toy inertia motor according to claim 8 wherein said first and third gears have stub shafts having blind bores, and said latch finger depends from said member into said blind bore on said first gear, and said motor further comprises spring means for biasing said first gear into its normal drive position and said third gear into its second gear disengaged position, said spring means comprising a wire spring having one end inserted into said blind bore on said third gear and the opposite end bearing against said latch finger.

* * * * *